United States Patent [19]

Bennett

[11] Patent Number: 4,497,486

[45] Date of Patent: Feb. 5, 1985

[54] DEVICE FOR SELECTING NUMBERS RANDOMLY

[76] Inventor: Robert A. Bennett, 170 Sturbridge Rd., Easton, Conn. 06612

[21] Appl. No.: 637,596

[22] Filed: Aug. 3, 1984

[51] Int. Cl.[3] ..... A63F 7/04

[52] U.S. Cl. ..... 273/144 B; 273/282; 273/287

[58] Field of Search ..... 273/144 B, 138 R, 282, 273/287, 157 R, 113, 115, 29 A, 15 R, 258, DIG. 31

[56] References Cited

U.S. PATENT DOCUMENTS

| | | | |
|---|---|---|---|
| 2,528,792 | 11/1950 | Seaman | 273/258 |
| 3,679,211 | 7/1972 | Hartley | 273/144 B |
| 3,795,401 | 3/1974 | Voltz et al. | 273/1.5 A |
| 3,866,918 | 2/1975 | Goldfarb et al. | 273/287 X |
| 3,968,967 | 7/1976 | Nally | 273/29 A X |
| 4,162,073 | 7/1979 | Norris | 273/144 B |
| 4,368,887 | 1/1983 | Gamble | 273/144 B |
| 4,444,394 | 4/1984 | Pasquine | 273/144 B |

FOREIGN PATENT DOCUMENTS

| | | | |
|---|---|---|---|
| 567216 | 5/1958 | Belgium | 273/DIG. 31 |
| 1094170 | 12/1960 | Fed. Rep. of Germany | 273/144 B |
| 3127075 | 1/1983 | Fed. Rep. of Germany | 273/282 |
| 1480344 | 4/1967 | France | 273/144 B |
| 2399701 | 4/1979 | France | 273/144 B |
| 7500129 | 7/1976 | Netherlands | 273/144 B |
| 276739 | 10/1951 | Switzerland | 273/DIG. 31 |
| 284626 | 12/1952 | Switzerland | 273/144 B |
| 853887 | 11/1960 | United Kingdom | 273/144 B |

OTHER PUBLICATIONS

Marshall Sales Lucky Numbers Number Selector Sales Flier, 4–1984.

*Primary Examiner*—Paul E. Shapiro

[57] ABSTRACT

A horizontal rectangularly shaped plate has a flat top surface which is enclosed by a transparent raised cover. A plurality of raised members hemispherically shaped are secured to the top surface in equidistantly spaced positions and extend upward being disposed below the inner surface of the cover. The members are disposed in rows and columns. Each two adjacent members in any row together with the two corresponding members in an immediately adjacent row define a cell with a centrally disposed region exposing the surface of the plate. One or more balls rest removably in one or more regions.

4 Claims, 5 Drawing Figures

DEVICE FOR SELECTING NUMBERS RANDOMLY

BACKGROUND OF THE INVENTION

In various types of games such as lotteries, a player must select a set of different numbers from a larger set of contiguous numbers as for example selecting six different numbers from the set of numbers one through thirty six inclusive.

The present invention is directed toward a new inexpensive device which can be operated manually by a player to enable the player to set a set of numbers at random from the larger set.

SUMMARY OF THE INVENTION

To this end, a horizontal rectangularly shaped plate has a flat top surface.

A first plurality of like members hemispherically shaped are secured to the top surface and extend upwardly. These members are equidistantly spaced from each other and define a second plurality of rows, each row containing the same number of members and a third plurality of columns, each column containing the same number of members. The number of rows can but need not be equal to the number of columns and the number of members in any row can but need not be equal to the number of members in column.

Each two adjacent members in any row together with the corresponding two adjacent members in the adjacent row define a cell. Each cell has a centrally disposed region exposing an underlying portion of the plate. Each cell is associated with a different number in the larger set of contiguous numbers.

One or more balls, spherical and with radii substantially equal to the radii of the members are disposed removably in the central regions of different cells. The number of balls is equal to the set of different numbers to be selected.

A raised transparent cover is secured to the periphery of the plate and extends above the members, the separation between the top of the members and the inner surface of the cover being larger than the diameter of the balls.

In use, the device is shaken and the balls fall at random into different central regions of different cells. The numbers associated with such different regions are then the selected numbers.

DETAILED DESCRIPTION OF PREFERRED EMBODIMENTS

Figure 1:
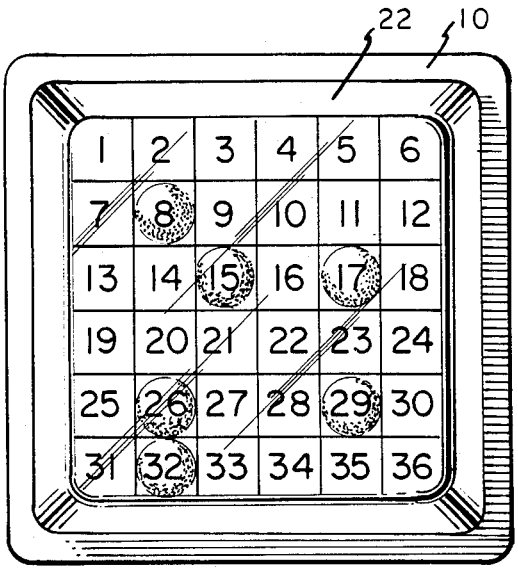
FIG. 1 is a top view of the invention.

Referring now to FIGS. 1–5, a plastic rectangular horizontal sheet has a flat rectangular border 10 of uniform thickness with a large central rectangular section having a recessed bottom surface 12 and a corresponding top surface 14. A first plurality, in this example equal to forty nine, hemispherically shaped members 16 extend upward from surface 14 in equidistantly spaced positons. As viewed from surface 12, these members each define a corresponding recess 18. These members define a second plurality, in this example seven, of rows each containing the same number, in this example seven, of members and a third plurality, in this example seven, of columns, each containing the same number seven, of members. The number of rows can differ from the number of columns and the number of members in a row can differ from the number of members in a column.

Figure 4:
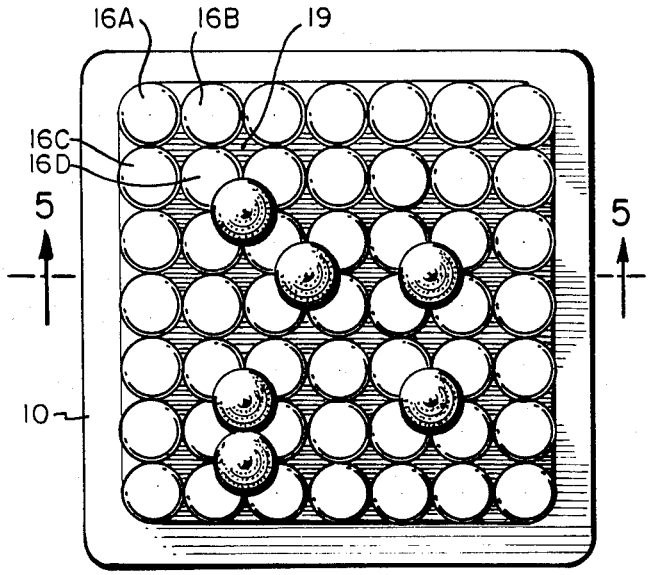
FIG. 4 is a top view of the invention with the cover removed.
Figure 2:
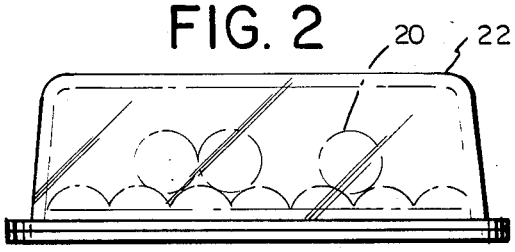
FIG. 2 is a side view thereof.
Figure 5:
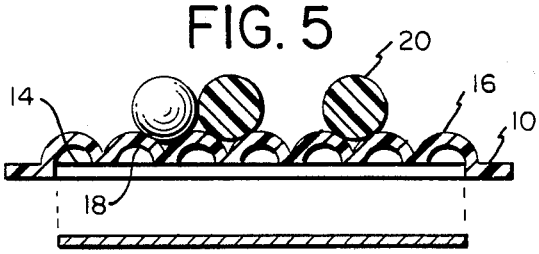
FIG. 5 is a cross sectional view taken along line 4—4 in FIG. 4.
Figure 3:
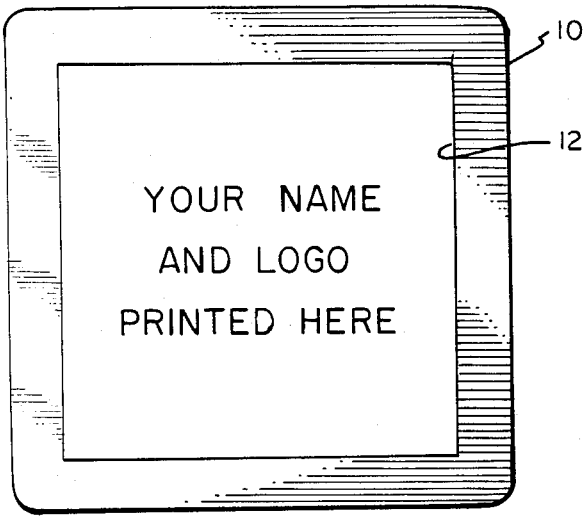
FIG. 3 is a bottom view thereof.

Each two adjacent members in any row together with the corresponding two adjacent members in an immediate row define a cell as shown for example by the four members identified at 16A, 16B, 16C and 16D in FIG. 4. Also as shown in FIG. 4, each cell has a centrally disposed region 19 exposing an underlying portion of surface 14.

A transparent plastic raised cover 22 is secured peripherally to the surface 14 and extends over the members 16. The cover carries numbers from one to thirty six, each number overlying the region 18 of a corresponding cell.

At least one spherical plastic ball 20, in this example six like balls, differing in color from that of the sheet and members are disposed between the members and the inner surface of the cover, the separation between the top of the members and the inner surface of the cover being larger than the diameter of each ball.

In use, the structure is shaken and the balls fall at random into different cells, thus providing a random selection of six numbers in the number set from one to thirty six inclusive.

The radius of each ball is substantially equal, in this example, to that of each member.

What is claimed is:

1. A device for selecting numbers comprising:

a horizontal rectangularly shaped plate having a flat top surface;

a first plurality of like members, each member being secured to the top surface of said plate and extending upwards, each member being hemispherically shaped, said members being equidistantly shaped and arranged into rows and columns, each row containing the same second plurality of members, each column containing the same third plurality of members, said first plurality being equal to the product of said second and third pluralities, each two adjacent members in any row together with the corresponding two adjacent members in an immediately adjacent row defining a cell, each cell having a centrally disposed region exposing an underlying portion of said plate, each region having a different number associated therewith;

at least one spherical ball adapted to rest removably in any region; and a transparent cover secured peripherally to said plate and extending over said members, the separation between the top of said members and the inner surface of said cover being larger than the diameter of said ball.

2. The device of claim 1 further including a fourth plurality of said balls, said fourth plurality being smaller than either one of said second or third pluralities.

3. The device of claim 2 wherein each of said members is hollow and defines a corresponding recess in the bottom surface of said plate, said members being integral with the plate.

4. The device of claim 3 wherein the radius of each member is substantially equal to the radius of each ball.

* * * * *